US009138123B2

(12) United States Patent
Classen et al.

(10) Patent No.: US 9,138,123 B2
(45) Date of Patent: Sep. 22, 2015

(54) DISHWASHER

(75) Inventors: Egbert Classen, Stahnsdorf (DE); Helmut Jerg, Giengen (DE); Hans-Peter Nannt, Gerstetten (DE); Kai Paintner, Adelsried (DE); Thomas Wachinger, Hohenzell (DE)

(73) Assignee: BSH Hausgeraete GmbH, Munich (DE)

( * ) Notice: Subject to any disclaimer, the term of this patent is extended or adjusted under 35 U.S.C. 154(b) by 1513 days.

(21) Appl. No.: 12/745,694

(22) PCT Filed: Nov. 20, 2008

(86) PCT No.: PCT/EP2008/065886

§ 371 (c)(1),
(2), (4) Date: Jun. 2, 2010

(87) PCT Pub. No.: WO2009/077286

PCT Pub. Date: Jun. 25, 2009

(65) Prior Publication Data

US 2011/0056527 A1 Mar. 10, 2011

(30) Foreign Application Priority Data

Dec. 14, 2007 (DE) ..... 10 2007 060 196

(51) Int. Cl.
*A47L 15/42* (2006.01)

(52) U.S. Cl.
CPC ..... *A47L 15/4221* (2013.01); *A47L 15/4202* (2013.01)

(58) Field of Classification Search
CPC ..... A47L 15/4214
See application file for complete search history.

(56) References Cited

U.S. PATENT DOCUMENTS

| | | | | |
|---|---|---|---|---|
| 3,363,763 | A | 1/1968 | Erickson | |
| 3,989,054 | A | 11/1976 | Mercer | |
| 4,730,630 | A * | 3/1988 | Ranft | 134/111 |
| 6,938,627 | B2 * | 9/2005 | Jung et al. | 134/104.2 |
| 7,040,490 | B2 | 5/2006 | Jerg | |
| 2003/0168087 | A1 | 9/2003 | Inui et al. | |
| 2005/0011546 | A1 | 1/2005 | Ertle et al. | |
| 2005/0022849 | A1 | 2/2005 | Park et al. | |
| 2005/0263174 | A1 * | 12/2005 | Yoon et al. | 134/104.1 |
| 2010/0012160 | A1 | 1/2010 | Jeong et al. | |

FOREIGN PATENT DOCUMENTS

| | | |
|---|---|---|
| DE | 1088469 | 9/1960 |
| DE | 2421157 A1 | 11/1975 |
| DE | 2428991 A1 | 1/1976 |

* cited by examiner

*Primary Examiner* — Jason Ko
(74) *Attorney, Agent, or Firm* — James E. Howard; Andre Pallapies

(57) ABSTRACT

A dishwasher comprising liquid lines that guide washing liquor towards spray devices arranged inside a washing receptacle. In an exemplary embodiment, the dishwasher includes a switch-over element, upon actuation of which, the washing liquor may be guided to a first liquid line leading to a first spray device, and/or to a second liquid line leading to a second spray device. The dishwasher may include at least one supplementary filter associated with the switch-over element.

45 Claims, 7 Drawing Sheets

DISHWASHER

BACKGROUND OF THE INVENTION

With water-conducting household appliances such as dishwashers for example, to prevent the line system in which washing liquor is circulated becoming contaminated by contamination particles, a filter system is used which can comprise a coarse-mesh filter, a fine-mesh filter and a micromesh filter. In such cases the coarse-mesh filter serves to hold back contamination particles which can lead to a blockage of the drain pump. Particles with a particle size of larger than approximately 1 mm are held back by a fine-mesh filter and particles with a particle size larger than approximately 0.15 mm are held back with a micromesh filter.

A water-conducting household appliance such as a dishwasher for example has a drain pump with which contaminated washing liquor can be conveyed out of the dishwasher into a domestic waste water drainage system at the end of the washing cycle. Such drain pumps are designed to enable them to convey larger particle sizes without hindrance and without the drain pump becoming blocked. Thus drain pumps are arranged such that the contaminated washing liquor is only coarsely filtered when pumped away.

In addition a dishwasher features a recirculation pump with which washing liquor can be circulated during the cleaning process, i.e. liquid collecting in the pump sump of a dishwasher is fed by means of the recirculation pump through a hydraulic system to spray arms arranged within the tub with which an even application of washing liquor to the items to be washed is undertaken. The spray arms have comparatively small openings so that it is necessary to guide the circulated washing liquor through the fine-mesh and micromesh filters so that the smallest particles are held back and the outlet openings of the spray arms cannot become blocked. Accordingly the recirculation pump is embodied in relation to the particle size tolerance.

The spray arms of a dishwasher can be supplied alternately with washing liquor during a washing process at predetermined intervals set by the washing program. In this way, despite a reduced amount of washing liquor overall, the washing liquor can be applied with high kinetic energy to the items to be washed.

A generic dishwasher is known from DE 24 28 991 A1, the spray apparatus of which can operate in this type of alternating mode. To this end the dishwasher features a switch-over element which, on actuation enables the washing liquor to be guided to a first liquid line leading to the first spray apparatus and/or to a second liquid line leading to the second spray apparatus.

BRIEF SUMMARY OF THE INVENTION

The object of the invention is to provide a dishwasher with a switch-over element with enhanced functionality.

In accordance with the invention, a supplementary filter is assigned to the switch-over element. The assignment of the supplementary filter to the switch-over element enables the mesh filter combination in the area of the tub floor in the return path to be reduced by one filter. Thus the space required overall for the filter combination is reduced so that the sump below the tub floor is able to have smaller dimensions. With a sump which is dimensioned correspondingly smaller the amount of dead water located therein and thus the heating power required to heat up the washing liquor is reduced.

In this case there is advantageously provision for the switch-over element and the at least one supplementary filter to be combined into one module, i.e. they are surrounded by a common housing, with both functionalities being combined into one module.

Preferably the supplementary filter can be movably coupled to the switch-over element. The turbulence in the flow of washing liquor caused by the switching movements of the switch-over element thus enable filter residue on the filter surface of the supplementary filter to be dislodged.

The supplementary filter can preferably be arranged on the pressure side of a recirculation pump circulating the washing liquor. The recirculation pump is less susceptible on its pressure side to pressure fluctuations in the washing liquor flow which might be caused by filter residue on the supplementary filter. In addition the supplementary filter can be positioned upstream from the switch-over element in the washing liquor flow direction, which prevents contamination of the switch-over element.

The supplementary filter arranged together with the switch-over element, by contrast with the mesh filter combination provided on the tub floor, is hard to access as regards installation. The supplementary filter can thus preferably be embodied as a self-cleaning filter in order to avoid time-consuming dismantling of the supplementary filter to clean it. The self cleaning of the supplementary filter can be supported by a scraper which wipes off filter residues from the filter surface through which the washing liquor flows. For a relative movement between the scraper and the supplementary filter, the scraper can be arranged permanently in relation to the supplementary filter in a distributor housing in which the switch-over element is also provided.

For technical implementation the switch-over element can be a rotatably-supported distributor element with at least one control opening. The distributor element, preferably a distributor disk can lie opposite a non-rotatable distributor panel with outlet openings to the first and second liquid line which lead respectively to the first or second spray apparatus. When rotated, the distribution disk can overlay the control opening of the first or the second outlet opening which accordingly directs the washing liquor through the control opening as well as the respective outlet opening to the first or second liquid line.

Preferably the distributor panel can be a top wall of the distributor housing, while the assigned distributor disk is supported rotatably on the inside of the housing on the top wall. The supplementary filter can either be positioned in front of the control opening or be arranged as a mesh insert within the control opening of the distributor disk.

With this type of roof wall-side arrangement of the distributor disk the filter residues do not remain on the supplementary filter but can be deposited by gravitational force on the floor of the distributor housing. From there the deposited filter residues can be removed from the distributor housing via a drain line.

The side wall connecting the top wall and the floor can have at least one inlet opening through which the washing liquor can be introduced into the distributor housing. It is useful in terms of the flow system for the scraper to be arranged on a side of the distributor housing opposite the inlet opening, whereby the depositing of the filter residues on the floor is not adversely affected.

In a first switch position the switch-over element can release the first liquid line and simultaneously block the second liquid line. Conversely, in a second switching position the switch-over element can block the first liquid line and release the second liquid line, which causes the spray apparatus to operate alternately, as already mentioned above.

Preferably the filter combination on the tub floor can feature a coarse filter and a fine filter which each have a larger mesh width compared to the supplementary filter. By contrast the supplementary filter can be a microfilter with a smaller mesh width by comparison with the coarse filter and fine filter. Since the supplementary filter lies downstream in the flow direction from the coarse filter and the fine filter, only pre-clarified washing liquor will flow through the supplementary filter, so that the supplementary filter will not be subjected at an early stage to heavily-contaminated washing liquor.

Preferably the supplementary filter can be designed to the self-cleaning. This type of self-cleaning filter can feature of least one disk-shaped filter means which sits on a hollow-cylindrical filtrate collection line. Washing liquor can be introduced through the filter means into the filtrate collection line. The collection line can in its turn be connected in flow system terms to the control opening in the distribution element.

Between the disk-shaped filter means and/or the housing walls at least one annular space can be provided through which the washing liquor can flow in a transverse flow direction. When the liquor flows over the filter surface of the disk-shaped filter means a filter cake or filter residue to be found on the filter surface is removed, which can then form a sediment on a tub floor. For this purpose an annular gap is provided between the disk-shaped filter means and the side wall of the distributor housing, via which the filter residues can be deposited on the floor of the distributor housing. Starting from the tub floor, the filter residues can be removed from the filter housing via a drain line. The drain line can be connected to the sump, via which the filter residues can be drained off into the waste water system.

To support a circular flow movement of the washing liquor introduced into the distributor housing, the distributor housing is embodied as a hollow cylinder. The washing liquor is thus preferably introduced tangentially along the inner side wall of the distributor housing and flows over the disk-shaped filter means in a circular transverse flow.

In a further embodiment the supplementary filter can feature at least one first individual filter and one second individual filter, each with different mesh widths. The first or second individual filter of the supplementary filter can be connected by means of an electronic control device to the hydraulic circuit of the dishwasher or decoupled from the latter. The two individual filters are thus not linked into the hydraulic circuit over the entire washing cycle but can just the connected in during predetermined washing cycle segments.

For a simple connection of the individual filters into the hydraulic circuit or for decoupling them, the above-mentioned distributor disk or the distributor element can have at least a first control opening with assigned first individual filter and a second control opening with assigned second individual filter.

This embodiment is based on the idea that with still heavily contaminated washing liquor, during the cleaning step for example, a coarse filtration of the washing liquor by the individual filter with the larger mesh width is already sufficient. By contrast, in the subsequent intermediate washing or rinsing step, the individual filter with a smaller mesh width, especially a microfilter, can be connected in, whereby a fine filtration is undertaken by means of which a re-contamination of the items to be washed is safely prevented. Consequently, in accordance with the invention, in the cleaning step the distributor disk with its first control opening in which the individual filter with a greater mesh width is provided can control the alternate operation of the spray devices. In the subsequent intermediate rinsing or final step the distributor disk can then control the alternate operation with its second control opening in which the individual filter with a smaller mesh width is provided.

In a further embodiment the changing of the mesh width of the supplementary filter is not undertaken by connecting a first or second individual filter. Instead the individual filter in accordance with a further embodiment can feature at least two mesh layers arranged above one another each with a predetermined mesh width. The mesh layers can for example be perforated sheets lying above one another, with the holes passing through them able to overlay each other completely or partly.

To set the overall mesh width of the supplementary filter the two mesh layers can be adjusted in their respective plane in relation to each other, whereby the overall mesh width of the supplementary filter is also set accordingly. To set the mesh width in this way at least one of the two mesh layers of the supplementary filter can be adjusted via a transmission element by a control device.

In a further embodiment the flow control of the washing liquor through the distributor housing can be designed so that in a self-cleaning operating mode the washing liquor removes the filter residue from the filter surface of the supplementary filter in a backflushing operation and takes it out of the distributor housing via a drain line. To this end the control opening with integrated supplementary filter can overlay the inlet opening for the washing liquor in the self-cleaning operating mode. On introduction of the washing liquor from the recirculation pump into the distributor housing a backflushing of the supplementary filter is thus undertaken. The backflushing flow can be taken out of the distributor housing together with the filter residue via the drain line.

Preferably the outlet openings to the first and second liquid lines as well as the inlet opening for the washing liquor can be arranged together in the distributor wall. By contrast, during a subprogram step, the assigned rotatable distribution element can overlay the respective outlet openings of the first and second liquid lines when fluid is used in alternate operation. In the self-cleaning mode the distributor element with its control opening can move past the two outlet openings and overlay the inlet opening for the washing liquor.

BRIEF DESCRIPTION OF THE DRAWINGS

Five exemplary embodiments are shown below which refer to the enclosed figures.

The figures show.

DETAILED DESCRIPTION OF EXEMPLARY EMBODIMENTS OF THE PRESENT INVENTION

Figure 1:
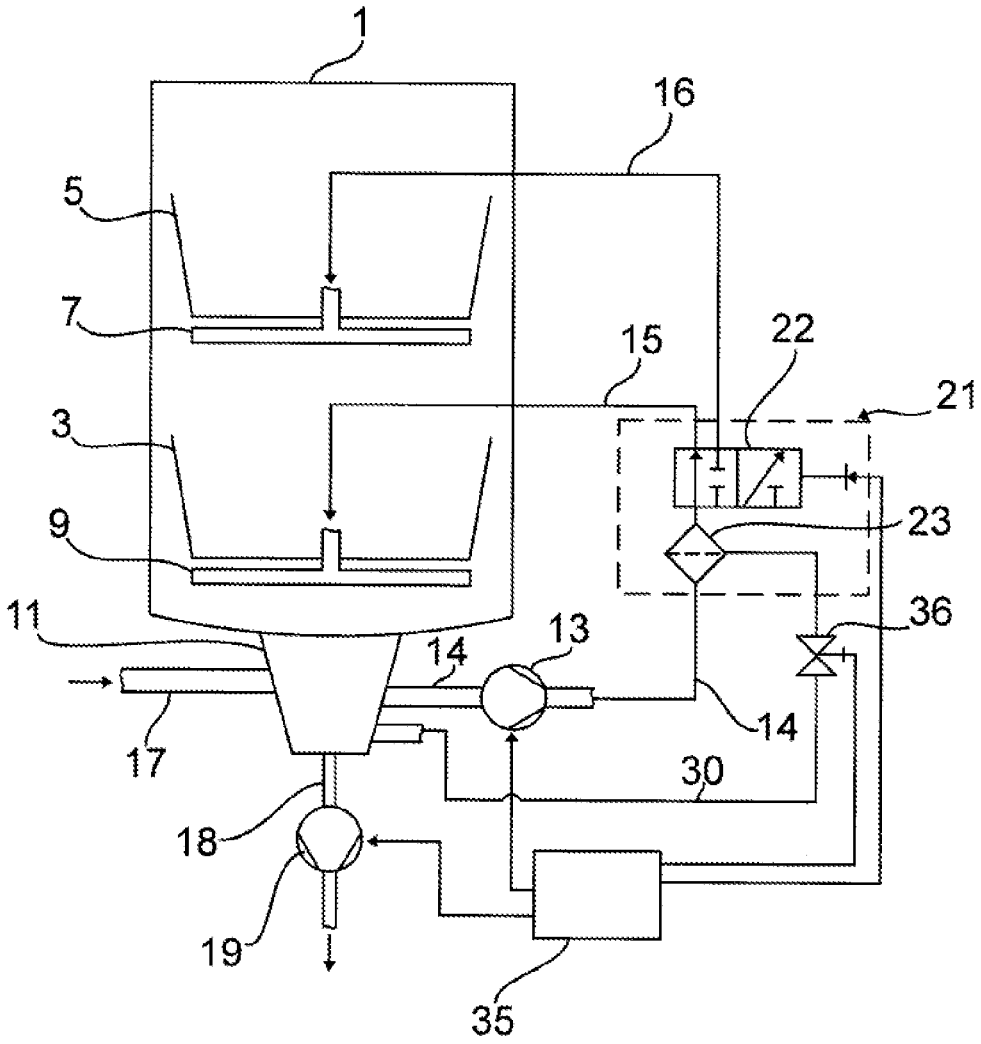
FIG. 1 a schematic block diagram of inventive dishwasher in accordance with the first exemplary embodiment.

FIG. 1 shows a rough schematic diagram of a dishwasher with a tub 1, in which items to be washed not shown in the figure can be arranged in crockery baskets 3, 5. In the tub 1 shown two spray arms 7, 9 arranged at different spray levels are shown by way of example as spray devices with which washing liquor can be applied to the items to be washed. Provided below the tub floor is a sump 11 with assigned recirculation pump 13 which is connected via liquid lines 14, 15, 16 in terms of flow to the spray arms 7, 9. The sump 11 is also connected via connection nozzles to a freshwater feed 17 coupled to the water supply network as well as a drain line 18 in which a drain pump 19 for pumping away contaminated washing liquor from the tub 1 is arranged.

As can also be seen from FIG. 1, a distributor 21 is located downstream from the recirculation pump 13 in the liquid line 14, via which during the washing cycle of the dishwasher the upper and lower spray 7, 9 are able to be supplied with washing liquor alternately. The distributor 21, in accordance with FIG. 1, in addition to a switch-over element 22 shown here as a switching valve, has an supplementary filter 23 which is located before the switch-over element 22. The switch-over element 22 is able to be switched between two switching states. In the first switching state shown in FIG. 1 the liquid line 15 is enabled during the washing cycle for the first spray 9 while the liquid line 16 to the upper spray 7 is decoupled from the hydraulic circuit. In the second switching state by contrast the liquid line 16 to the upper spray arm 7 is enabled while the liquid line 15 is decoupled from a hydraulic circuit.

Figure 2:
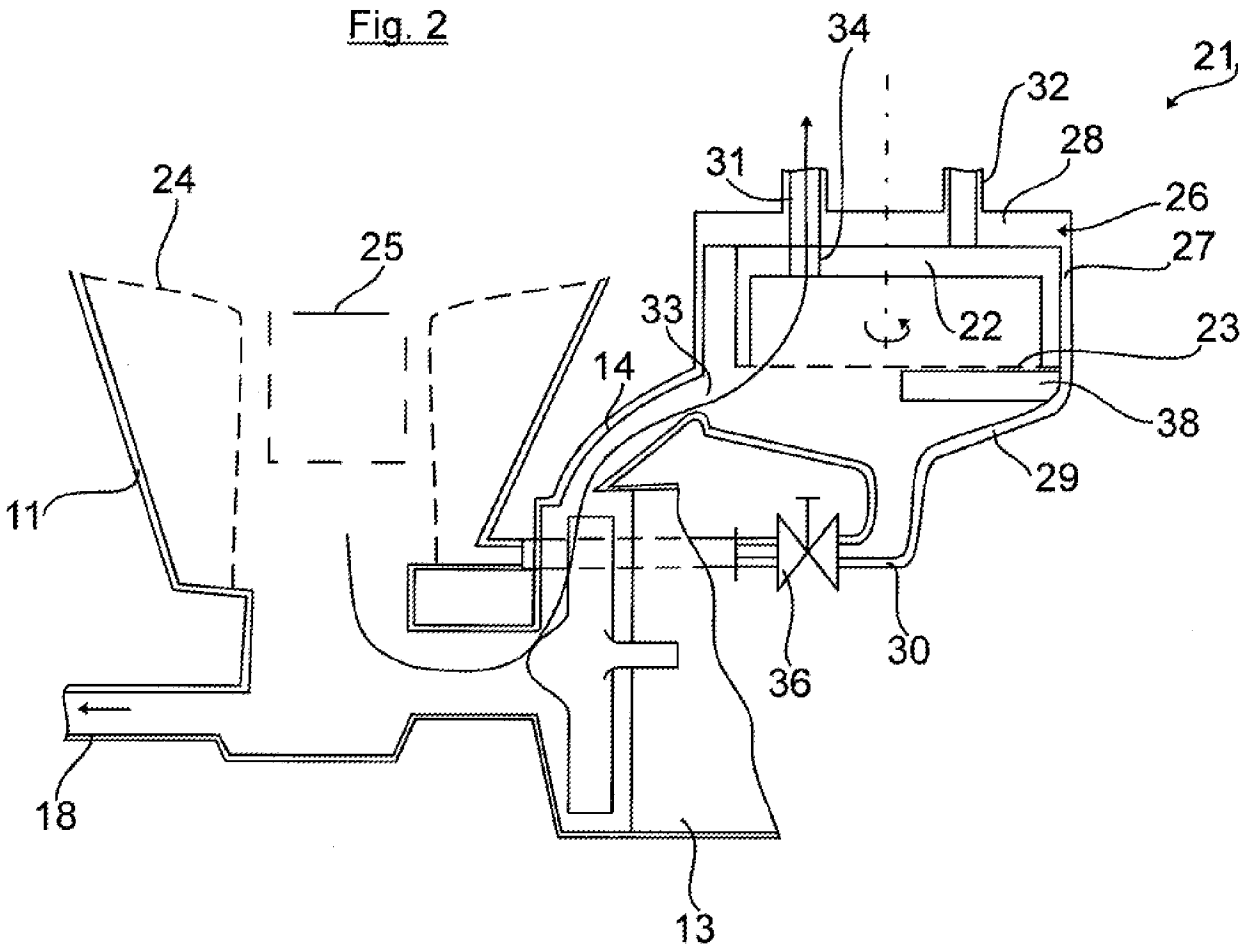
FIG. 2 a part of a hydraulic circuit of the dishwasher with assigned distributor housing.

The supplementary filter 23 located before the switch-over element 22 is a part of an overall three-part filter system of the dishwasher, as is shown in FIG. 2. The filter system, in addition to the supplementary filter 23, also comprises a fine filter 24 as well as a coarse filter 25. The fine filter 24 is embodied as a flat mesh filter covering the sump 11, for example a perforated metal sheet which is aligned flush with the floor of the tub. The coarse filter is provided as a conventional removable bowl-shaped coarse-mesh filter in the central area of the funnel-shaped fine filter 24. In the three-part filter system the coarse filter 25 has the largest mesh width while the fine filter 24 is embodied with a smaller mesh width. The supplementary filter 23 by comparison is a microfilter with the smallest mesh width.

As can be seen from FIG. 2, the supplementary filter 23 is provided as a flat filter insert in the housing 26 of the distributor 21. The distributor housing 26 is embodied as a hollow cylinder with a surrounding side wall 27 as well as a top wall 28 and a floor 29 opposite it running down into the shape of a funnel. In the central area of the floor 29 running down into the shape of a funnel, a fluid outlet is connected to a drain 30. The drain 30 is connected in terms of flow to the sump 11.

Provided in the top wall 28 of the distributor 21 are connecting pieces with outlet openings 31, 32 for the liquid lines 15, 16 to be routed to the spray arms 7, 9. Arranged in the cylindrical side wall 27 on the other hand is an inlet opening 33 via which the liquid line 14 can feed washing liquor into the interior of the distributor. Provided in the interior of the distributor is a distributor disk 22 supported rotatably on the top wall 28 as a switch-over element 22. The distributor disk 22 is typically located in FIG. 2 in sliding contact with the top wall 28 and has a control opening 34. The control opening 34, depending on the rotational position of the distributor disk 22, can either overlay the first outlet opening 31 leading to the lower spray arm 9 or the second outlet opening 32 leading to the upper spray arm 7.

As can also be seen from FIG. 2, the distributor disk is embodied in the shape of a bowl with a surrounding side edge, to the lower end of which the supplementary filter 23 is attached. The supplementary filter 23 is a micromesh filter embodied as a flat surface here. Provided on its filter surface facing towards the flow of the washing liquor is a scraper 38, which is held non-rotationally on the housing side wall and protrudes into the interior of the distributor. The scraper 38 has its scraper edge resting on the filter surface, whereby during a rotational actuation of the distributor disc 22 any filter residue can be removed from the filter surface if necessary. The filter residue filtered out by the supplementary filter 23 collects in the central area of the funnel-shaped floor 29. From there the filter residue can be taken via the drain 30 out of the distributor housing 26, as is described below.

The inlet opening 33 for the washing liquor and the scraper 38 are positioned opposite one another on the cylindrical inner housing wall 26. The removal of filter residues which are wiped off by the scraper 38 and collect on the floor 29 is thus not adversely affected by the introduced flow of washing liquor.

Figure 3:
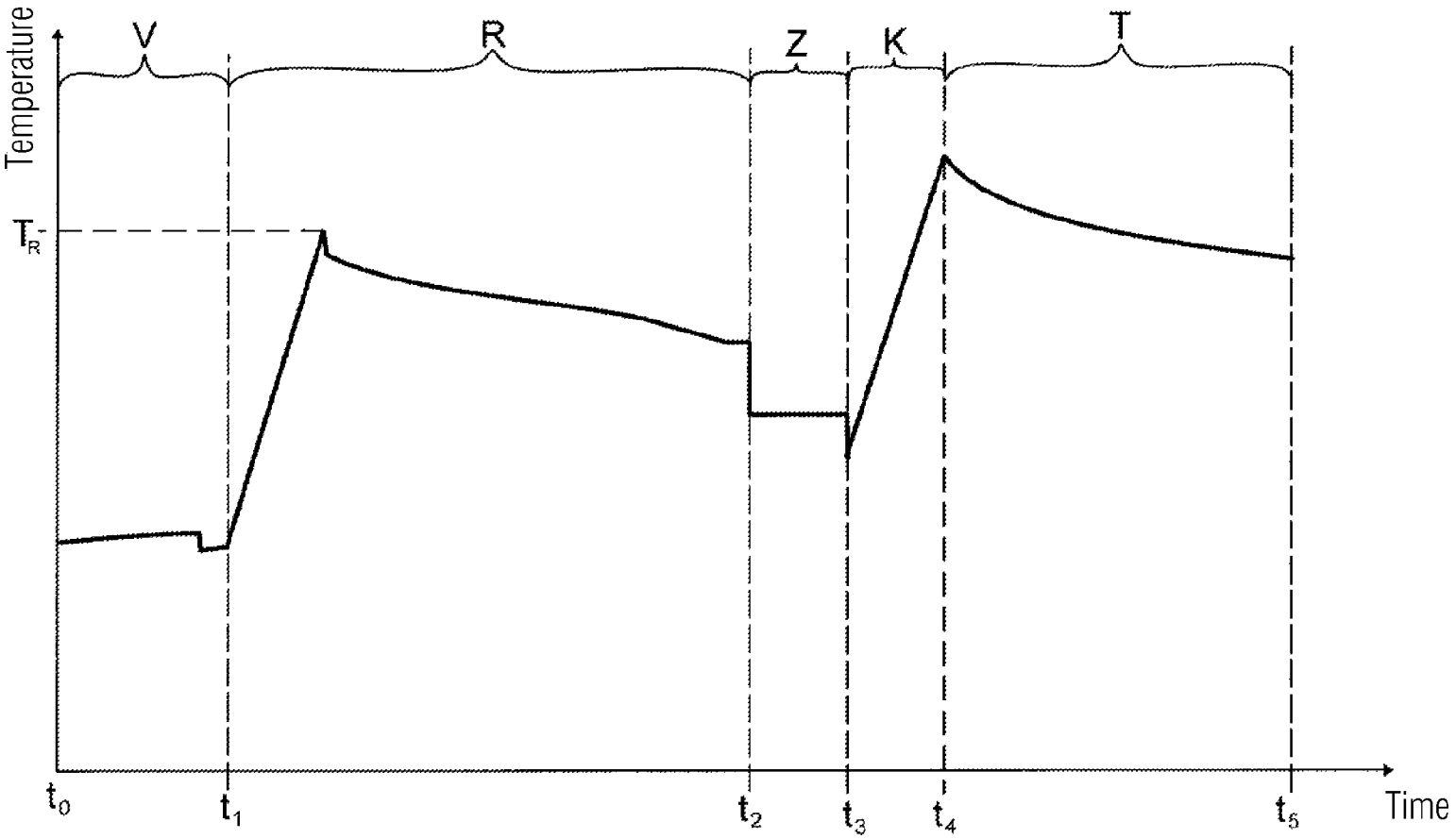
FIG. 3 a temperature-time profile illustrating the subprogram steps during a washing cycle of the dishwasher.

FIG. 3 shows the timing of the program sequence with the individual subprogram steps of a washing cycle of the dishwasher, namely pre-washing V, cleaning R, intermediate rinsing Z, final rinsing K and drying T. The program sequence is controlled by means of a control device 35 shown in FIG. 1. The control device 35 is connected for signaling purposes to units such as the recirculation pump 13, the drain pump 19, the switch-over element 22 and also a magnetic valve 36 which is arranged in the drain 30 from the distributor housing 26.

The program sequence is controlled in the usual way by means of the electric control device 35. During the subprogram steps where washing liquor is used, i.e. the pre-wash V, the cleaning R, the intermediate rinsing Z and the final rinsing K, the control device switches over the switch-over element formed as a distributor disk at predetermined intervals. The two spray arms 7, 9 thus have washing liquor applied to them individually. At the end of each subprogram step where washing liquor is used, the control device 42 puts the drain pump into operation in order to convey the contaminated washing liquor out of the tub 1 into the waste water system. At the same time as the drain pump 19 is put into operation the control device 35 opens the magnetic valve, whereby the filter residues collected on the distributor housing floor 29 are also conveyed via the drain 30 and the sump 11 into the waste water system.

Figure 4:
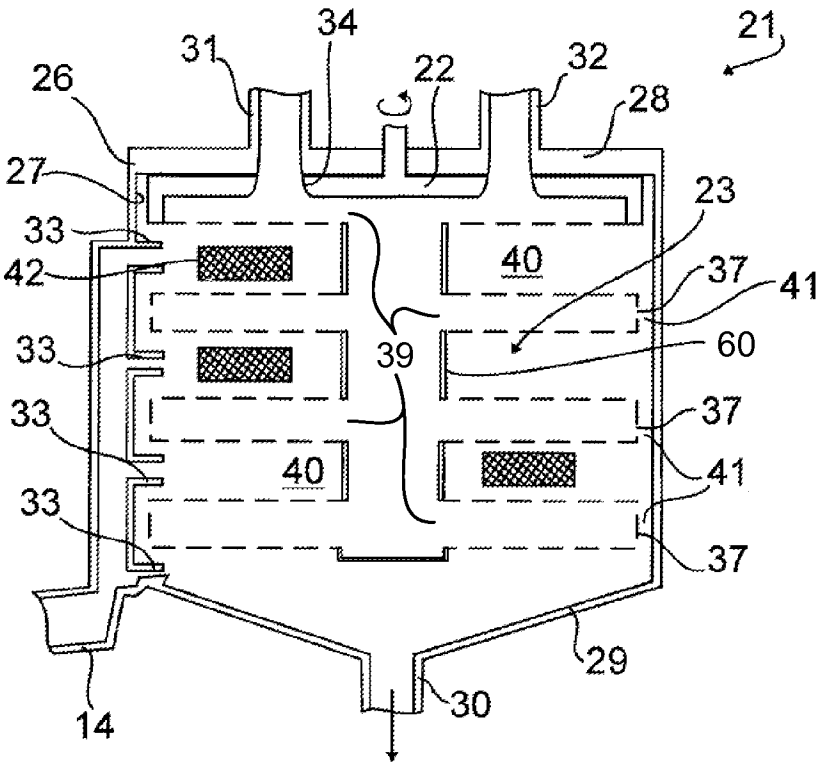
FIG. 4 a distributor in accordance with the second exemplary embodiment shown on its own.

Shown on its own in FIG. 4 is the distributor housing 26 in accordance with the second exemplary embodiment. The distributor housing 26 of FIG. 4 is able to be used in a dishwasher as is shown in FIG. 1, which reference is made.

Unlike the distributor 21 of FIG. 2 the supplementary filter 23 in accordance with FIG. 4 is not defined as a flat-surface micromesh filter, instead the supplementary filter 23 has a series of disk-shaped filter means 37 which sit on a filtrate collection line 60. The filter means 37 are connected in terms of the flow system to the cavity 39 of the filtrate collection line 60. The filtrate collection line 60 extends coaxially to a central axis of the hollow-cylindrical distributor housing 26 into its interior. The disc-shaped filter means 37 sit spaced from each other in the axial direction on the line 60.

Embodied between the spaced-apart disk-shaped filter means 37 are annular spaces 40 through which the washing liquor to be filtered flows in a circular transverse flow. The inlet openings 33 for the washing liquor in the radial direction protrude slightly into the annular spaces 40. To support a circular transverse flow in the annular spaces 40, the inlet openings 33 can be aligned in a tangential direction to the cylindrical sidewall 27 of the distributor housing 26. The filter residues deposited on the filter surfaces of the disc-shaped filter means 37 are thus forced by a centrifugal action onto the cylindrical sidewall 27 and can sink there along the cylindrical sidewall 27 down to the funnel-shaped housing floor 29. For this purpose the outer circumferential edges of the disc-shaped filter means 37 are spaced via an annular gap 41 from the sidewall 27. The filter residues collecting on the housing floor 29 can be conveyed back to the sump 11 via a drain 30 from where they are conveyed by means of the drain pump 19 into the waste water system.

In the annular spaces 40 in the distributor housing 26 freely-movable cleaning bodies 42 are provided which are moved with the circular transverse flow of the washing liquid through the annular spaces 40. The cleaning bodies 42 support a removal of residues adhering to the filter surfaces of the filter means 37.

Figure 5:
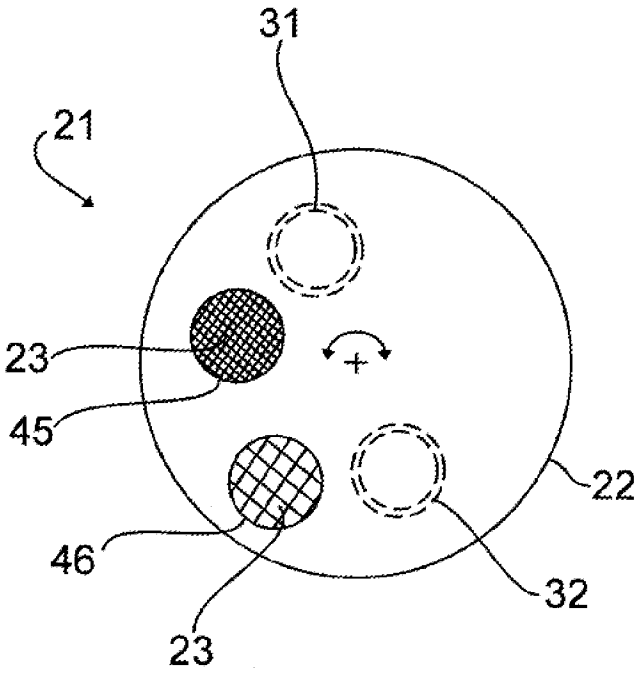
FIG. 5 a distributor in accordance with the third exemplary embodiment in a view from above.

Shown in FIG. 5 is a view from above of a distributor disk 22 of a distributor 21 in accordance with the third exemplary embodiment. The distributor 21 in accordance with the third exemplary embodiment is also able to be used in the dishwasher shown in FIG. 1. The distributor 21 also corresponds in its basic structure to the distributor 21 shown in FIG. 2. Thus the distributor 21 in accordance with the third exemplary embodiment features the distributor housing 26 with the top wall 28 in which the two outlet openings 31, 32 connected to the liquid lines 15, 16 are provided.

By contrast with FIG. 2, the distributor disk 22 arranged rotatably in the distributor housing 26 does not have just one control opening provided within it. Instead the distributor disk 22 has a set of control openings consisting of two control openings 45, 46 for each outlet opening 31, 32. Supplementary filters having different mesh widths are inserted into the two control openings 45, 46 of the control opening set in each case.

By contrast with the previous exemplary embodiments, depending on the rotational position of the distributor disk 22, supplementary filters 23 with different mesh widths are thus able to be switched into the hydraulic circuit of the dishwasher or are able to be decoupled from this hydraulic circuit. With reference to the washing cycle of the dishwasher illustrated in FIG. 3, during pre-washing V and cleaning R the control opening 46 with the coarse-mesh supplementary filter 23, depending on the rotational position of the distributor disk 22, can release the two outlet openings 31, 21 in alternating mode. During pre-washing V and cleaning R there is thus only a sufficient coarse filtration of the washing liquor. By contrast, the two control openings 45 with the fine-mesh supplementary filters 23 are decoupled from the hydraulic circuit.

In the subsequent intermediate rinsing Z or final rinsing K, instead of the control opening 46, the control opening 45 with the fine-mesh supplementary filter 23 is moved into the flow cross-section of the two outlet openings 31, 32. In accordance with FIG. 5 the supplementary filters 23 are each mesh filter inserts which extend flush within the control openings 45, 46.

Figure 6:
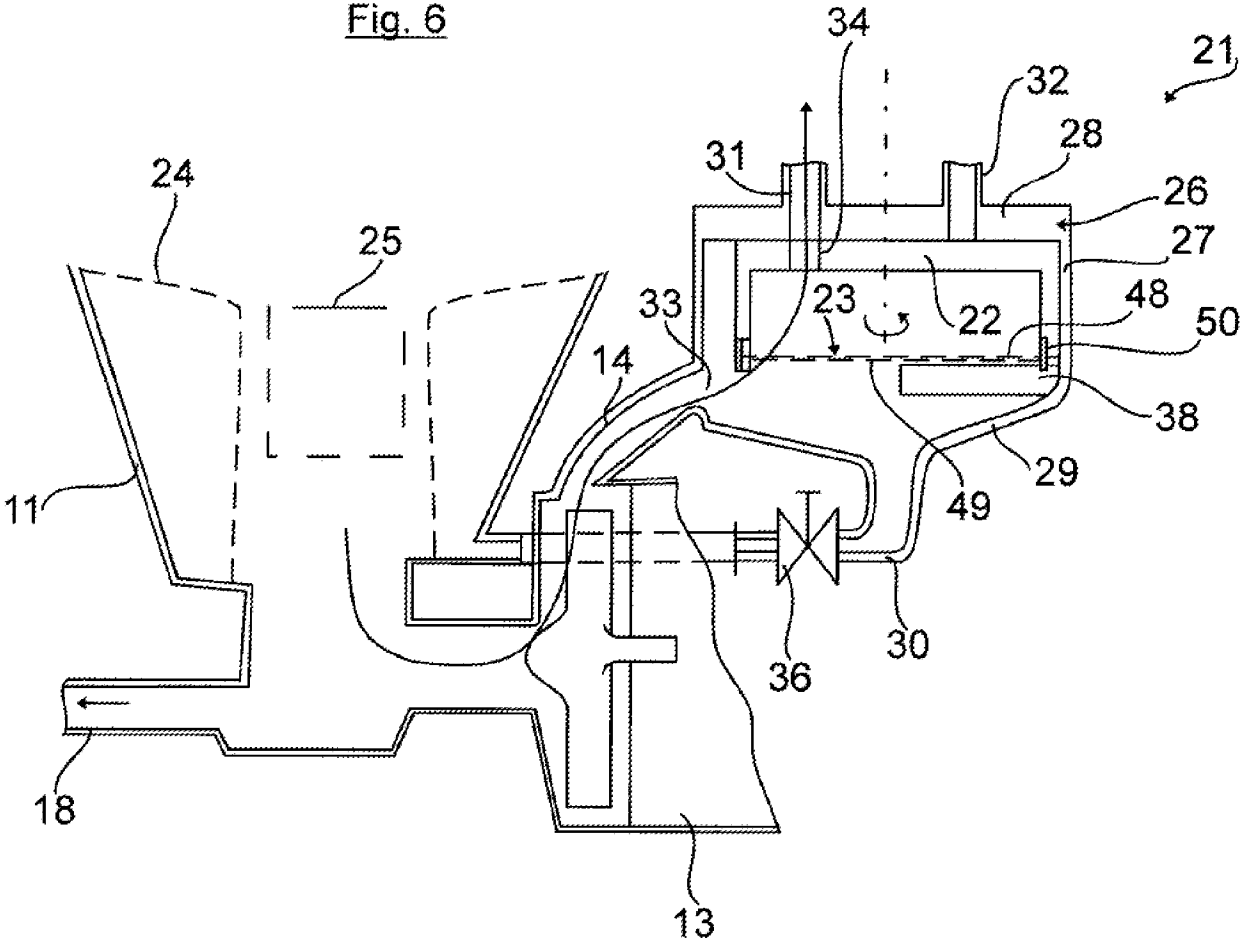
FIG. 6 in a view corresponding to that shown in FIG. 2, a distributor in accordance with the fourth exemplary embodiment.

Shown in FIG. 6 is an enlarged side view of the distributor 21 corresponding to FIG. 2 in accordance with the fourth exemplary embodiment which corresponds to the basic structure of the distributor 21 of FIG. 2 so that the reader may refer back to the description of FIG. 2 in relation to its structure and its functions. By contrast with FIG. 2, the supplementary filter 23 features two mesh filter layers 48, 49 arranged above each other, each with a predetermined mesh width, which are in contact so that they can slide on one another. The two mesh filter layers 48, 49 are enclosed at their edges in an annular transmission element 50 only shown roughly in the diagram. The transmission element 50 is able to be controlled by the control device 35 such that the two mesh filter layers 48, 49 can be adjusted in relation to each other, which enables the overall mesh width of the supplementary filter 23 to be enlarged or reduced. The mesh filter layers 48, 49 can be perforated metal sheets lying above one another, which with their respective part mesh width produce the adjustable overall mesh width of the supplementary filter 23. The filter surface of the supplementary filter 23 facing towards the washing liquor flow is, as also shown in the exemplary embodiment of FIG. 2, assigned to the scraper which wipes the filter surface to remove filter residues.

Figure 8:
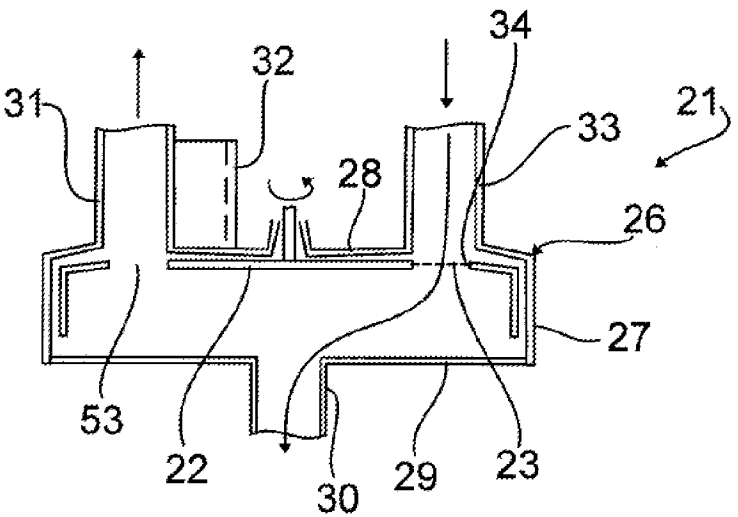
FIGS. 7 and 8 a distributor housing in accordance with the fifth exemplary embodiment in different operating states respectively.
Figure 7:
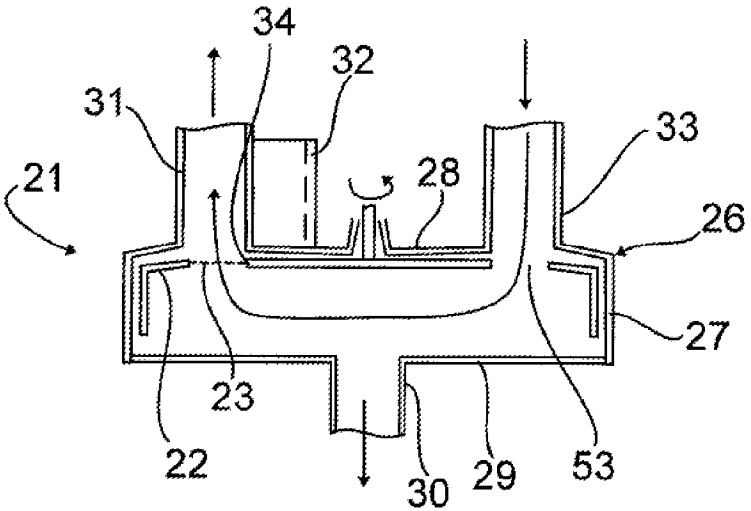

Shown in the subsequent FIGS. 7 and 8 is a distributor 21 in accordance with the fifth exemplary embodiment in different operating states. The distributor 21 shown in FIG. 7 is basically identical in its functions and its structure to the distributor of FIG. 2. By contrast with FIG. 2, the inlet opening 33 for washing liquor is not arranged in the side wall 27 of the distributor housing 26 but is located in the top wall 28 and is located jointly with the two outlet openings 31, 32 to the liquid lines 15, 16. In the floor area 29 the distributor housing 26 also has an outlet opening with a drain line connected to it, through which the filter residues can be removed from the filter housing 26.

As can further be seen from FIG. 7, the distributor disk has the control of opening 34 on one side and on the other side the supplementary through opening 53 through which the washing liquor can flow into the interior of the distributor housing. In accordance with FIG. 7 the supplementary filter 23 is arranged as a mesh insert filter within the control opening 34.

In FIG. 7 the distributor disk 22 is shown in a switch position during a subprogram step when liquid is being used, in which the washing liquor is conducted from the recirculation pump 13 via the inlet opening 33 and the through opening 53 into the interior of the distributor housing and flows out from there via the supplementary filter 23 through the outlet opening 31. In order to guarantee a fault-free alternating operation, the through opening 53 is dimensioned like a slot so that when the control opening 34 is overlaid with the adjacent outlet opening 32 the washing liquor can flow through the through opening 53 into the interior of the distributor housing.

By contrast with FIG. 7, in FIG. 8 the distributor 21 is shown in a self-cleaning operating mode. In this operating mode the distributor disk 22 is put into a rotational position in which the control opening 34 overlays the inlet opening 33 for the washing liquor. On actuation of the recirculation pump 13 the washing liquor can now flow through the supplementary filter 23 in a backflushing direction. This removes filter residues from the filter surface of the supplementary filter 23. To remove the filter residues from the distributor housing 26, the control device 35 can both switch on the drain pump 19 and also open the magnetic valve in the drain 30, which enables the filter residues to be conveyed out of the distributor housing into the waste water system.

LIST OF REFERENCE SIGNS

| | |
|---|---|
| 1 | Tub |
| 3 | Crockery basket |
| 5 | Crockery basket |
| 7 | Spray arm |

-continued

| LIST OF REFERENCE SIGNS | |
|---|---|
| 9 | Spray arm |
| 11 | Sump |
| 13 | Recirculation pump |
| 14 | Liquid line |
| 15 | Liquid line |
| 16 | Liquid line |
| 17 | Fresh water line |
| 18 | Drain line |
| 19 | Drain pump |
| 21 | Distributor |
| 22 | Switch-over element |
| 23 | Supplementary filter |
| 24 | Fine filter |
| 25 | Coarse filter |
| 26 | Distributor housing |
| 27 | Sidewall |
| 28 | Top wall |
| 29 | Distributor housing floor |
| 30 | Drain |
| 31 | Outlet opening |
| 32 | Outlet opening |
| 33 | Inlet opening |
| 34 | Control opening |
| 35 | Control device |
| 36 | Magnetic valve |
| 37 | Filter means |
| 38 | Through opening |
| 40 | Annular spaces |
| 42 | Cleaning body |
| 45 | Control openings |
| 46 | Control openings |
| 48 | Mesh layer |
| 49 | Mesh layer |
| 50 | Drive element |
| 53 | Through opening |
| V | Pre-washing |
| R | Cleaning |
| Z | Intermediate rinsing |
| K | Final rinsing |
| T | Drying |

The invention claimed is:

1. A dishwasher, comprising:

a tub;

a plurality of spray devices arranged in the tub;

a plurality of liquid lines structured to conduct washing liquor to the spray devices;

a primary filter provided on a floor of the tub; and a switch-over element structured to convey the washing liquor to a first liquid line of the plurality of liquid lines leading to at least one of a first spray device of the plurality of spray devices and a second liquid line of the plurality of liquid lines leading to a second spray device of the plurality of spray devices, wherein the switch-over element in a first switch position releases the first liquid line and blocks the second liquid line and in a second switch position blocks the first liquid line and releases the second liquid line, and wherein the switch-over element includes at least one supplementary filter that is supplemental to the primary filter.

2. The dishwasher as claimed in claim 1, wherein the switch-over element and the at least one supplementary filter are configured as one component.

3. The dishwasher as claimed in claim 1, wherein the at least one supplementary filter is coupled movably to the switch-over element.

4. The dishwasher as claims in claim 1, wherein the at least one supplementary filter is disposed downstream of a pressure side of the recirculation pump.

5. The dishwasher as claimed in claim 1, wherein the at least one supplementary filter is disposed to filter liquid entering the switch over element.

6. The dishwasher as claimed in claim 1, further comprising a scraper structured to wipe off filter residues from a filter surface of the at least one supplementary filter.

7. The dishwasher as claimed in claim 6, wherein the scraper is fixed permanently in relation to the at least one supplementary filter.

8. The dishwasher as claimed in claim 1, wherein the primary filter comprises a coarse filter and a fine filter, and wherein the coarse filter and the fine filter are provided on the floor of the tub and have a greater mesh width than the at least one supplementary filter.

9. The dishwasher as claimed in claim 1, wherein the at least one supplementary filter is self-cleaning.

10. The dishwasher as claimed in claim 1, wherein the at least one supplementary filter includes at least one disk-type filter which sits on a filtrate collection line.

11. The dishwasher as claimed in claim 10, further comprising a distributor element, and wherein the filtrate collection line is connected with a control opening of the distributor element.

12. The dishwasher as claimed in claim 11, wherein at least one annular space through which the washing liquor is able to flow is arranged between at least one of the at least one disk-type filter and housing walls of the dishwasher.

13. The dishwasher as claimed in claim 12, further comprising at least one freely-movable cleaning body disposed in the at least one annular space which supports a removal of filter residues adhering to a filter surface of the at least one disk-type filter.

14. The dishwasher as claimed in claim 13, wherein the distributor housing is a hollow cylinder.

15. The dishwasher as claimed in claim 14, further comprising an annular gap disposed between the at least one disk-type filter and a side wall of the distributor housing, via which filter residues are deposited on a floor of the distributor housing.

16. The dishwasher as claimed in claim 1, wherein the at least one supplementary filter includes at least one individual filter and a second individual filter having different mesh widths.

17. The dishwasher as claimed in claim 16, wherein the at least one individual filter and the second individual filter of the supplementary filter are connected and decoupled by an electronic control device to a hydraulic circuit of the dishwasher.

18. The dishwasher as claimed in claim 17, wherein the at least one individual filter and the second individual filter are connected and decoupled depending on a respective subprogram of a washing cycle.

19. The dishwasher as claimed in claim 18, wherein the switch-over element comprises a distributor disk, the distributor disk having at least one first control opening with assigned first supplementary filter and a second control opening with assigned second supplementary filter.

20. The dishwasher as claimed in claim 19, wherein the distributor disk with at least one of its first control opening and second control opening enables the first liquid line and the second liquid line.

21. The dishwasher as claimed in claim 20, wherein the at least one supplementary filter includes at least two mesh filter layers arranged above one another which are adjustable in their respective plane in relation to one another for setting a mesh width of the at least one supplementary filter.

22. The dishwasher as claimed in claim 21, wherein at least one of the two mesh filter layers of the supplementary filter is structured to be adjusted by a control device using a transmission element.

23. The dishwasher as claimed in claim 1, wherein the at least one supplementary filter is arranged as a mesh insert filter within a control opening of the distributor element.

24. The dishwasher as claimed in claim 1, wherein the supplementary filter, during a subprogram, allows the washing liquor to flow through it in a first direction of flow.

25. The dishwasher as claimed in claim 24, wherein in a self-cleaning operating mode, a controlled opening of the distributor element overlays a washing liquor inlet opening.

26. The dishwasher as claimed in claim 25, wherein outlet openings to the first and second liquid lines and also the inlet opening for the washing liquor are arranged jointly in the distributor wall.

27. The dishwasher as claimed in claim 26, wherein the distributor element has a through opening which, during the subprogram, overlays the inlet opening for the washing liquor.

28. The dishwasher as claimed in claim 1, wherein the primary filter comprises a coarse filter and a fine filter, both filters having a greater mesh width than the at least one supplementary filter.

29. The dishwasher as claimed in claim 1, wherein the switch-over element is configured to switch between multiple operating states in which the washing liquor is conveyed to at least one of the first liquid line and the second liquid line.

30. The dishwasher as claimed in claim 29, wherein the switch-over element is positioned upstream of a drain pump.

31. The dishwasher as claimed in claim 1, wherein the switch-over element is arranged together with the at least one supplementary filter in a common distributor housing.

32. The dishwasher as claimed in claim 31, wherein the switch-over element is a rotatably-supported distributor disk with at least one control opening, which lies opposite a non-rotating distributor wall with at least one outlet opening to at least one of the first liquid line and the second liquid line.

33. The dishwasher as claimed in claim 32, wherein the non-rotating distributor wall is a top wall of the common distributor housing.

34. The dishwasher as claimed in claim 31, wherein the common distributor housing includes a floor with a drain for filter residues.

35. The dishwasher as claimed in claim 31, wherein the common distributor housing includes a side wall with at least one inlet opening through which the washing liquor can be introduced into the common distributor housing.

36. The dishwasher as claimed in claim 35, wherein the scraper is arranged on a side of the distributor housing lying opposite the at least one inlet opening.

37. The dishwasher as claimed in claim 1, wherein the supplementary filter is configured to filter washing liquor regardless of the switch position.

38. A switch-over element for a dishwasher with a primary filter and a recirculation pump, the switch-over element being structured to convey a washing liquor to a first liquid line of a plurality of liquid lines leading to at least one of a first spray device of a plurality of spray devices and a second liquid line of the plurality of liquid lines leading to a second spray device of the plurality of spray devices, the switch-over element comprising:

an inlet;

a first outlet configured to be connected to the first liquid line;

a second outlet configured to be connected to the second liquid line; and at least one supplementary filter that is adapted to be supplemental to the primary filter, wherein the switch-over element is configured to selectively operate in a first mode and a second mod, the inlet being fluidly disconnected from the first outlet in the first mode and being fluidly disconnected from the second outlet in the second mode, and wherein an output of the switch-over element is filtered by the at least one supplementary filter regardless of the mode in which the switch-over element is operating.

39. The switch-over element of claim 38, wherein the at least one supplementary filter is configured to be positioned downstream of a pressure side of the recirculation pump of the dishwasher.

40. A dishwasher, comprising:

a tub;

a first filter provided on a floor of the tub;

a first liquid line structured to conduct washing liquor to a first spray device arranged in the tub;

a second liquid line structured to conduct the washing liquor to a second spray device arranged in the tub;

a switch-over element adapted to receive a pressurized flow of the washing liquor from a source and selectively engage and disengage the first and second liquid lines from the pressurized flow to distribute the washing liquor between the first and second liquid lines; and a second filter associated with the switch-over element.

41. The dishwasher as claimed in claim 40, wherein the second filter is adapted to receive the pressurized flow of the washing liquor.

42. The dishwasher as claimed in claim 40, wherein the second filter is coupled movably to the switch-over element.

43. The dishwasher as claimed in claim 40, wherein the second filter is disposed to filter liquid entering the switch over element.

44. The dishwasher as claimed in claim 40, wherein the switch-over element is arranged together with the second filter in a common housing.

45. The dishwasher as claimed in claim 44, wherein the common housing includes a floor with a drain for filter residues.

* * * * *